United States Patent [19]

Stice

[11] Patent Number: 4,919,563

[45] Date of Patent: Apr. 24, 1990

[54] VEHICLE PARKING OR PASSAGEWAY SECURITY BARRIER

[76] Inventor: David L. Stice, 4625 Applewood, Odessa, Tex. 79761

[21] Appl. No.: 393,127

[22] Filed: Aug. 14, 1989

[51] Int. Cl.[5] ..... E01F 13/00

[52] U.S. Cl. ..... 404/6; 49/49

[58] Field of Search ..... 194/900, 901, 902, 903; 254/11, 93 R, 103; 74/426; 404/6, 85; 70/163, 164, 166, 167, DIG. 56, 398, 399; 206/1.5; 49/49

[56] References Cited

U.S. PATENT DOCUMENTS

| | | | |
|---|---|---|---|
| 3,086,430 | 4/1963 | Emmel | 404/6 |
| 4,576,508 | 3/1986 | Dickinson | 404/6 |
| 4,666,331 | 5/1987 | Riley | 404/6 |
| 4,715,742 | 12/1987 | Dickinson | 49/49 |

FOREIGN PATENT DOCUMENTS

| | | | |
|---|---|---|---|
| 02576 | 11/1980 | Fed. Rep. of Germany | 404/9 |

*Primary Examiner*—Jerome W. Massie, IV

*Assistant Examiner*—Roger J. Schoeppel

*Attorney, Agent, or Firm*—Robert C. Peterson

[57] ABSTRACT

A vehicular trafficway or roadway barrier or space barrier for controlling access to the same. The apparatus is installed below the parking space or roadway and includes a retractable barrier which blocks the space being protected when erected and permits access when retracted. The apparatus herein referred to as Scopelock is an entirely self-contained unit which may be operated from normal electrical service or a battery. The entire unit is designed to be unlocked and removed from a casing that is permanently fixed into the ground. Spaceage material protects the unit from moisture. Scopelock can be operated by remote control or coin boxes or keys as desired. Typically, when in place, Scopelock prevents access to vehicular parking spaces while at the same time, capable of providing parking security by limiting the space between Scopelock and other barriers positioned around the vehicles, thereby providing security from theft of the vehicle. Scopelock is of the nature that it can be installed in any vehicular trafficway.

12 Claims, 5 Drawing Sheets

VEHICLE PARKING OR PASSAGEWAY SECURITY BARRIER

BACKGROUND OF INVENTION

This invention relates to barrier control means and in particular, to a security barrier for use in controlling vehicular access to parking areas and passageways such as highways and byways by use of a retractable barrier denominated "Scopelock."

In view of the proliferation of vehicular traffic in cities and urban areas, there is an increasing need for controlling access of such vehicles in parking areas and roadways. It is particular important in maintaining security and availability of parking around emergency areas such as ambulance parking areas as well as paid parking and private parking areas.

In the past, various means of controlling parking space access and roadway travel have been proposed. In one such example, U.S. Pat. No. 3,849,936, employs a barrier plate which is pivotal along one side from a horizontal to a near vertical position. This particular invention requires a barrier that is substantially the length or width of the entire vehicle, consequently adding cost and expense. U.S. Pat. No. 4,715,742 to Dixon, describes an anti-terrorist barricade capable of stopping movement of vehicles unauthorized to enter a trafficway. The mechanism includes a spring lift means with a trigger mechanism which upon triggering, releases the spring and a bollard (or barrier) is erected. Such a system would be subject, of course, to environmental exposure which could cause operating problems. U.S. Pat. No. 4,576,508 to Dickenson, describes a bollard type trafficway barrier for arresting vehicles which includes a hydraulic lift that requires a sufficient source of hydraulic power and is subject to underground environmental exposure and thus is somewhat undesirable. This system is somewhat complicated and is practically not feasible for widespread use in routine parking or traffic control applications.

Other systems utilize gates such as that described in U.S. Pat. No. 3,368,305 to Piekarski, which is currently a typical installation in parking areas in such regions as airports and downtown parking lots, hospital areas and other private parking areas. Such devices suffer from being easily damaged by a vehicle running into the gate or the mechanism failing to operate for other reasons and, of course, such things are subject to vandalism since the mechanism is entirely above ground. There are little, if any, provisions in the prior art for mechanically raising or lowering the barrier if, for whatever reason, there is a power failure or other mechanical failure in the power source whether electric or hydraulic.

SUMMARY OF THE INVENTION

The present invention comprehends a new and improved vehicle barrier to prevent ingress and egress to an area desired to be restricted such as hospital emergency parking and doctor only parking areas, as well as public or private parking areas using an affirmative barrier to prevent access to such restricted areas which is a substantially self-contained mechanism with the moving parts substantially contained below ground in a sealed casing and with the mechanism for raising and lowering the barrier substantially sealed from the environment.

Scopelock may be operated by remote control permitting the scope tube or bollard to be raised or lowered by remote control from a vehicle or other area and includes switch operation or can employ a loop detector for the presence of metal to prevent Scopelock from activating when a vehicle is near or over the top of the unit. Further, the unit may be fully self-contained with a battery operated mechanism for controlling its operation in raising and lowering the scope tube.

Scopelock is anchored to the ground by its casing to prevent tampering with the mechanism, however, access by a keylock is permitted by removing the scope tube head after unlocking and removing the keylock. Such action permits access to the scope tube which may be removed, as well as access to an adjusting height control mechanism. Moreover, if the scope tube mechanism has, for whatever reason, lost power in the erected position, the top of the scope tube can be removed to provide access to the screw drive which can be operated to lower the scope tube into its retracted position. Furthermore, the entire Scopelock unit is secured below the surface in a casing which is securely implanted therein with a retainer flange welded thereto and may be removed therefrom by unlocking and removing a second security lock in a bezel or security cover. When the lock is removed, the bezel is rotated and removed, then the entire Scopelock unit is accessible. The complete unit may be removed and a new unit installed in a matter of minutes if necessary. Furthermore, removal of the bezel provides access to the electronic control box to replace or repair electrical units.

Scopelock is a device which may be installed in various applications for denying or permitting access to certain secured or controlled areas which includes, among other things, parking spaces, traffic lanes, boat ramps, emergency traffic areas such as hospital emergency unloading zones, airport taxiways and manned or unmanned parking in buildings and airports and the like. Scopelock is an advanced access control mechanism which can operate from the retracted to the erected position or from the erected to the retracted position in five seconds. The mechanism is capable of being modified to increase the speed such that the rate could be as low as perhaps two seconds for one way travel.

More specifically, the invention comprises a vehicular access control called Spacelock which can be quickly activated or deactivated as necessary for controlling ingress and egress of vehicles in a restricted area that is mounted under the surface area to be protected to permit free access; a bollard or scope tube which, when activated, rapidly ascends to block access to the restricted area and rapidly descends when deactivated; a sealed security cover or bezel and retainer flange means which securely locks Scopelock in a casing permanently secured below the surface of the restricted area and when unlocked, provides quick removal of the entire Scopelock from its casing for ready replacement; a scope tube containing a keylock which when removed permits ready removal of the scope tube, adjustment to the height of the scope tube in the raised or lowered position as well as permitting mechanical lowering of the scope tube should there be a power failure or electronic fault while the scope tube is in the erected position; and a screw drive system for erecting or retracting the scope tube having a motor and electronic motor control which may be operated remotely from within a vehicle, including safety features which would prevent Scopelock from being activated when a vehicle or other metal was within the way of Scopelock erection or if Scopelock encountered more than a preset force opposing erection, would shut Scopelock down and prevent its operation.

The remote control means for activating Scope Lock may include the typical remote systems currently in use for gate control systems, remote automobile garage door opener systems such as the system disclosed by S. W. Rose, U.S. Pat. No. 3,041,507, the gate control system of L. Piekarski, U.S. Pat. No. 3,368,305 or the area gate control system of J. H. Auer, Jr., U.S. Pat. No. 3,063,179 and such other devices as are currently on the market.

Each Scopelock would be coded with an appropriate signal to which it would respond either individually or, if necessary, in multiples or groups of Scopelocks.

It is therefore an object of the invention to provide a new and improved rapidly activated vehicle access control system for restricted areas or trafficways which is placed below the surface or grade of the restricted area, including a scope tube or barrier riser erection mechanism for allowing or denying access, thereby limiting damage to the scope tube and access to height control or retracting mechanism that are readily accessible through a keylock system, as well as a keylock system which can be deactivated and the entire Scopelock assembly may be removed as a unit from the casing for replacement or merely provide access to the electronic controls and the control box which is also secured to the casing, but accessible by removing the bezel.

It is therefore an object of the invention to provide a new and improved rapidly activated vehicle access control system for restricted areas or trafficways which includes a tubular riser means for a screw drive mechanism which erects or retracts a scope tube or barrier.

It is therefore an object of the invention to provide a new and improved rapidly activated vehicle access control system for restricted areas or trafficways in which a screw drive system operates a cable riser means attached to the bottom of the scope tube or barrier for erecting and retracting the scope tube.

The foregoing and various other objects and features of this invention will be apparent and fully understood from the following detailed description of the typically preferred form and applications thereof throughout which description reference is made to the accompanying drawings.

DESCRIPTION OF THE PREFERRED EMBODIMENTS

Figure 1:
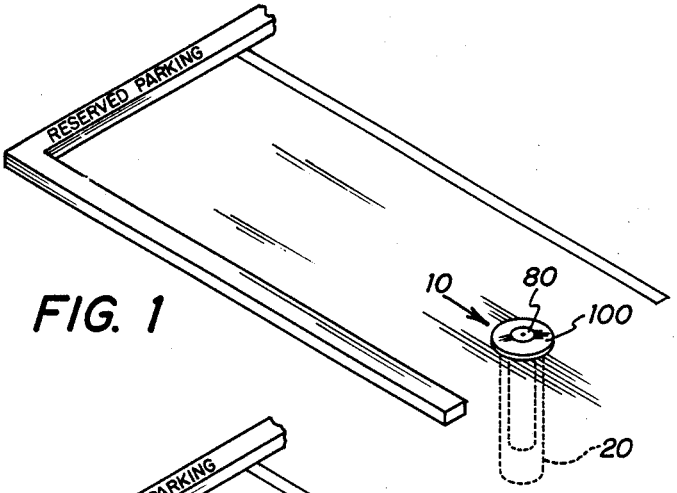
FIG. 1 illustrates a perspective view of the general layout of the Scopelock in the retracted position mounted flush with the surface of a parking space in accordance with the present invention.
Figure 2:
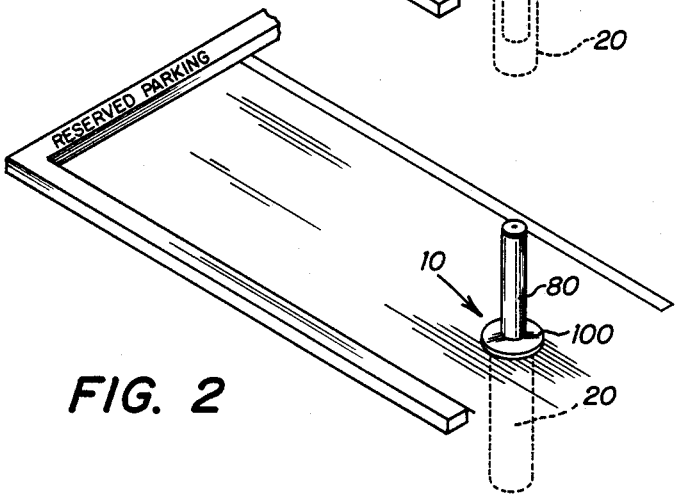
FIG. 2 illustrates a perspective view of Scopelock as in FIG. 1 with the scope tube erected, preventing vehicular movement in the space.
Figure 7:
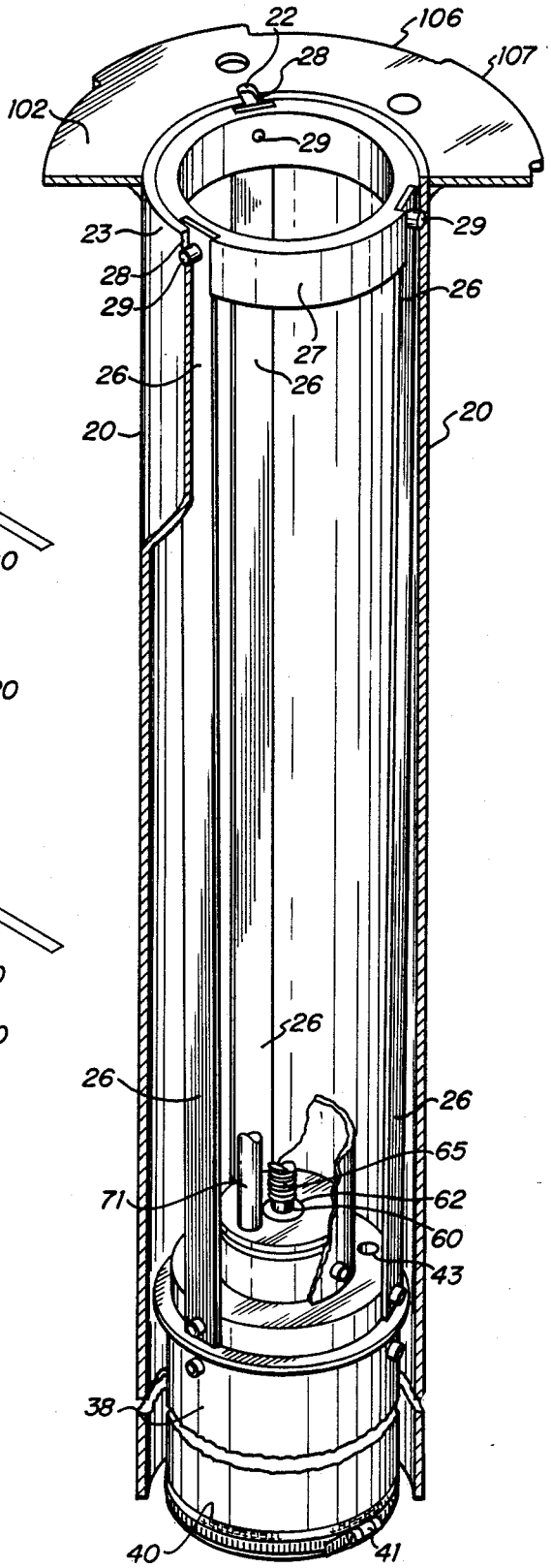
FIG. 7 is a perspective view which illustrates the hanger suspension for Scopelock.

In the exemplary embody of the invention, reference is made to the drawings. FIGS. 1 and 2 show Scopelock in a typical use situation for controlling access to a parking space. In FIG. 1 Scopelock is shown in its retracted position substantially flush with the surface to permit ingress and egress from the parking space whereas in FIG. 2, Scopelock is in the erected position, blocking the parking space to prevent either ingress to or egress from the space. FIGS. 1 and 2 describe only one application of Spacelock, and it will be appreciated that Spacelock may be used in lieu of gate control systems, roadway or trafficway access control systems, private and emergency driveways and other applications to deny or limit access to such areas as boat launching ramps, taxiways and the like.

Figure 3:
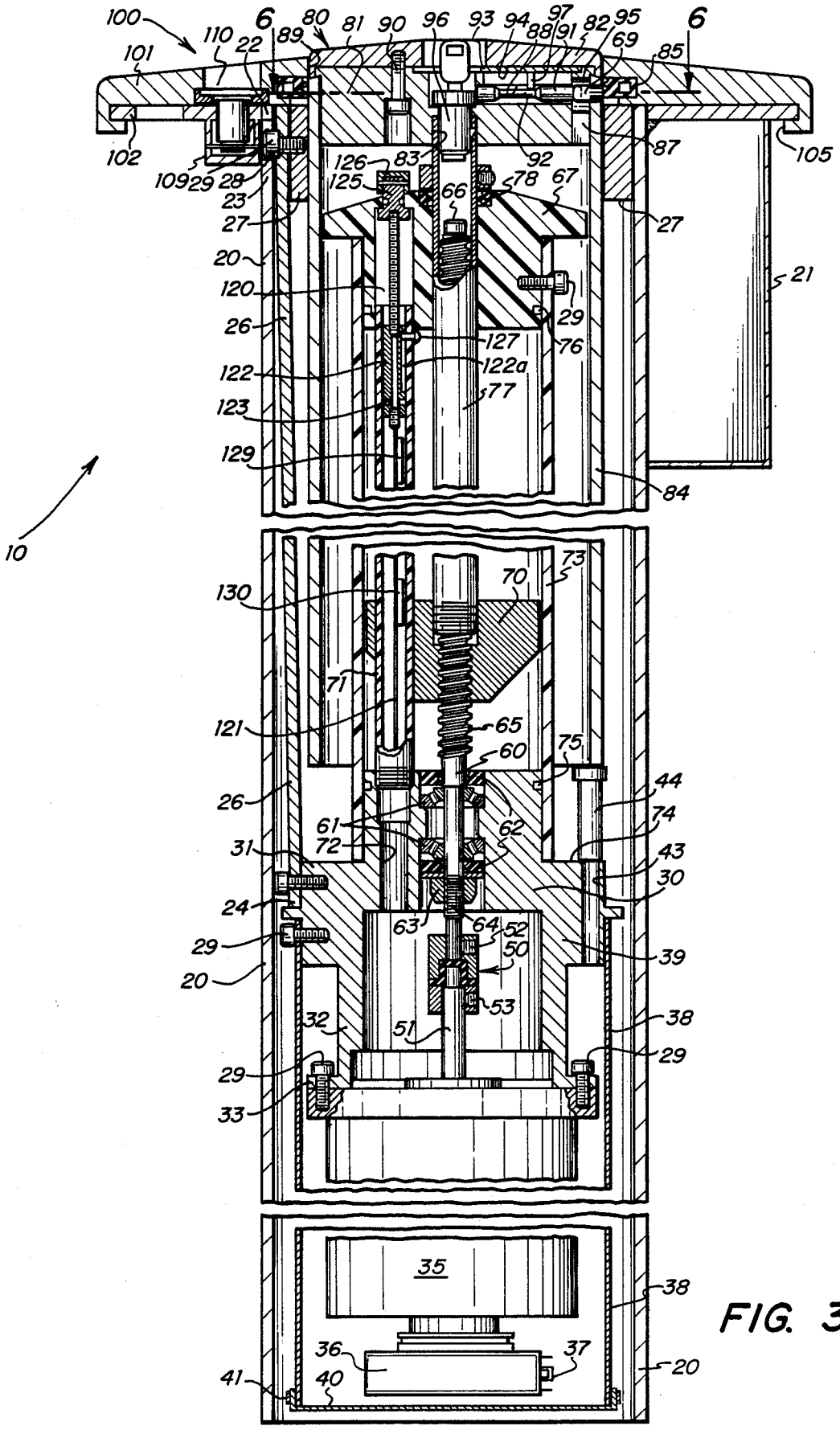
FIG. 3 is a sectional view along a segment, slightly shorter than the diameter of the Scopelock to expose the screw drive mechanism and related parts.
Figure 4A:
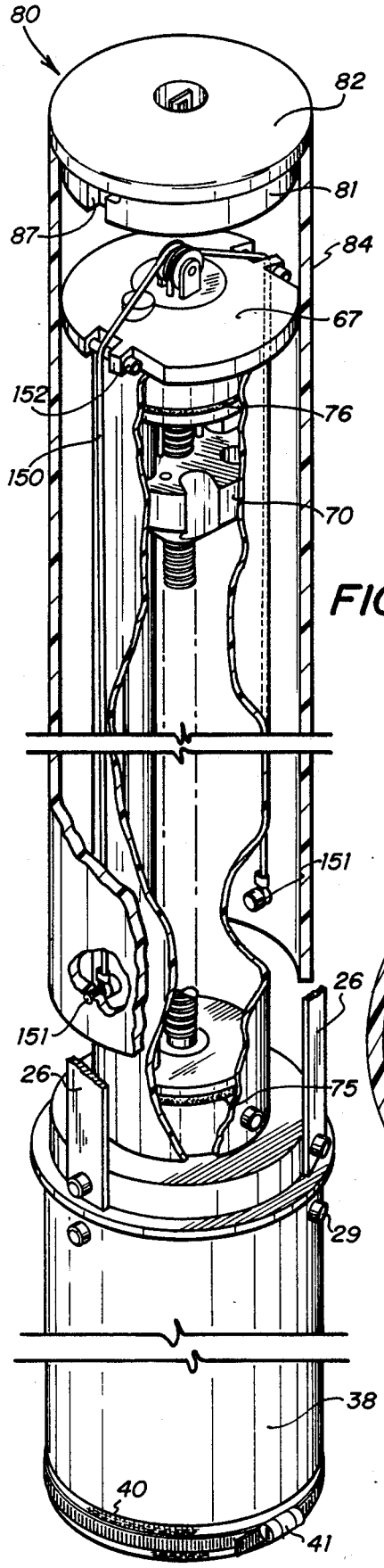
FIG. 4*a* and 4*b* are exploded and broken away views of the limit switch assembly and guide tube for the traveler nut and screw drive assembly in the cable riser version.

Referring now to FIGS. 3 through 7, and in particular FIGS. 3, 4 and 6, the tubular riser screw drive mechanism of Scopelock will be described in detail. Scopelock generally referred to as 10 has an outer casing 20 which is embedded below the pavement, and may be permanently fastened by concrete or the like or any suitable means. The casing includes, at its upper area, an electronic box 21 which is open at the upper end as shown in FIG. 3 which as later discussed, permits easy access to the electronics for Scopelock. The outer casing has three slots or cut outs 22 at its upper most end 23. Three hanger straps 26 are attached to hanger top guide 27 in the guide slots 28 by three allen head screws 29. The hanger top guide is of sufficient diameter to provide minimal clearance from the cylindrical casing 20. As later described, the hanger straps 26 support the entire Scopelock mechanism and the entire bearing load of the Scopelock is supported in the cylindrical casing by the heads of allen screws 29 which rest in support slots 22 at the upper most end 23 of cylindrical casing 20. A main bearing housing 30 is attached by three allen head screws 29 to the lower most end 24 of hanger straps 26. The housing 30 is formed with three spacer members 32 integral with a motor support ring 33. Motor 35 is suspended from motor support ring 33 by allen head bolts 29. Motor capacitor 36 having a power contact 37 is attached to motor 35 directly. The motor 35 and the motor capacitor 36 are sealed in a motor canister 38, attached to the lower central portion 39 of main bearing housing 30 and is secured by three allen head bolts 29. The bottom of the motor canister low capacitor 36 is closed with a space-age material identified as gortex. The gortex closure 40 is attached with clamp 41. Gortex permits the flow of air in and out of the motor canister, but does not transmit moisture. Gortex material provides a barrier to moisture flowing into the motor housing while permitting heat to be dissipated through the movement of air through the gortex material. It requires in the neighborhood of 30 pounds or more of pressure to get water to move through the gortex material. This provides extra protection for the motor and drive coupling from the environment. The central portion of main bearing housing 30 has a through port 43 for access within the motor canister 38 for the motor wiring. The through port 43 may contain an electrical connector which is coupled to the motor wiring and the wiring harness from the electronics control box 21 is coupled to the connector 44.

Referring now particularly to FIGS. 3, 4, 7, and 8, a drive shaft 60 is mounted by upper and lower bearings 61 in the central opening of main bearing housing 30. The bearings 61 have seals 62 for preventing oil leaks. The lower end of drive shaft 60 has threads 64 and lock nut 63 is screwed onto thread 64 of drive shaft 60 to hold the bearings and seals in place. The lock nut 63 then turns with the drive shaft. The upper end of drive shaft 60 has a multiple lead thread 65 extending from just above the bearing housing 30 throughout the length of drive shaft 60 and extends into the bore of top plastic cover 67. A traveler nut 70 is threaded onto multiple lead threads 65. Travel nut 70 is fluted as best seen in FIGS. 4*a* and 4*b* to accommodate plastic tube stabilizer 71 which is threadedly seated in through port 72 and extends along the fluted side of traveler nut 70 and is seated at its upper end in top plastic cover 67. Tubular housing 73 is seated against bearing housing face 74 and is sealed to the main bearing housing 30 by o-ring seals 75. Top plastic cover 67 is seated in the upper end of tubular housing 73 and is secured therein by three allen head bolts 29 and sealed therein by o-ring seal 76. Plastic tube stabilizer 71 prevents traveler nut 70 from rotating thus forcing it to travel up or down when drive shaft 60 is rotated in one direction or the other. The tubular housing 73 guides traveler nut 70 up and down as drive shaft 60 rotates. Riser tube 77 extends over multiple lead threads 65 of drive shaft 60 and is threadably engaged in traveler nut 70 and extends through top plastic cover 67 and is sealed from leakage by o-ring 78. Lock plate 81 of scope tube assembly 80 has a bore 83 which fits over riser tube 77. It will now be observed that when motor 35 turns drive shaft 60 clockwise as viewed in FIG. 3, traveler nut 70 will move along multiple lead thread 65 carrying riser tube 77 along therewith and forcing the scope tube assembly to rise or become erected as illustrated in FIG. 2.

Figure 6A:
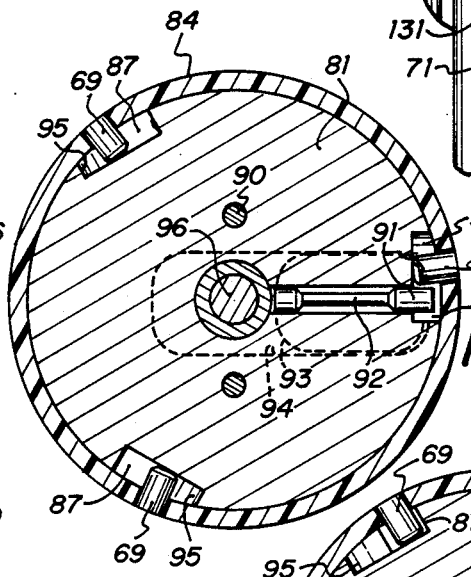
FIGS. 6*a* and 6*b* and top sectional views taken along Q—Q in FIG. 8 which illustrate the scope tube lock plate assembly.
Figure 6B:
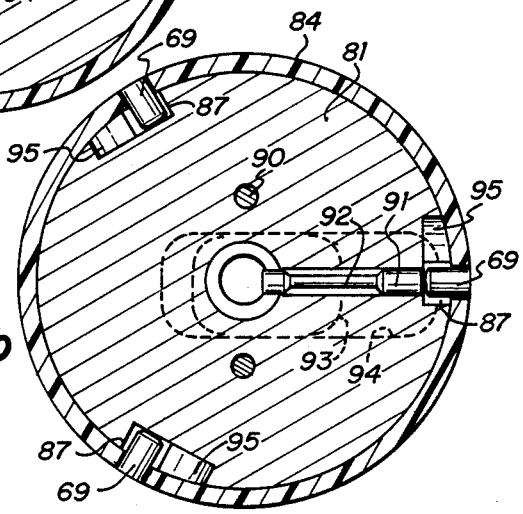
Figure 5:
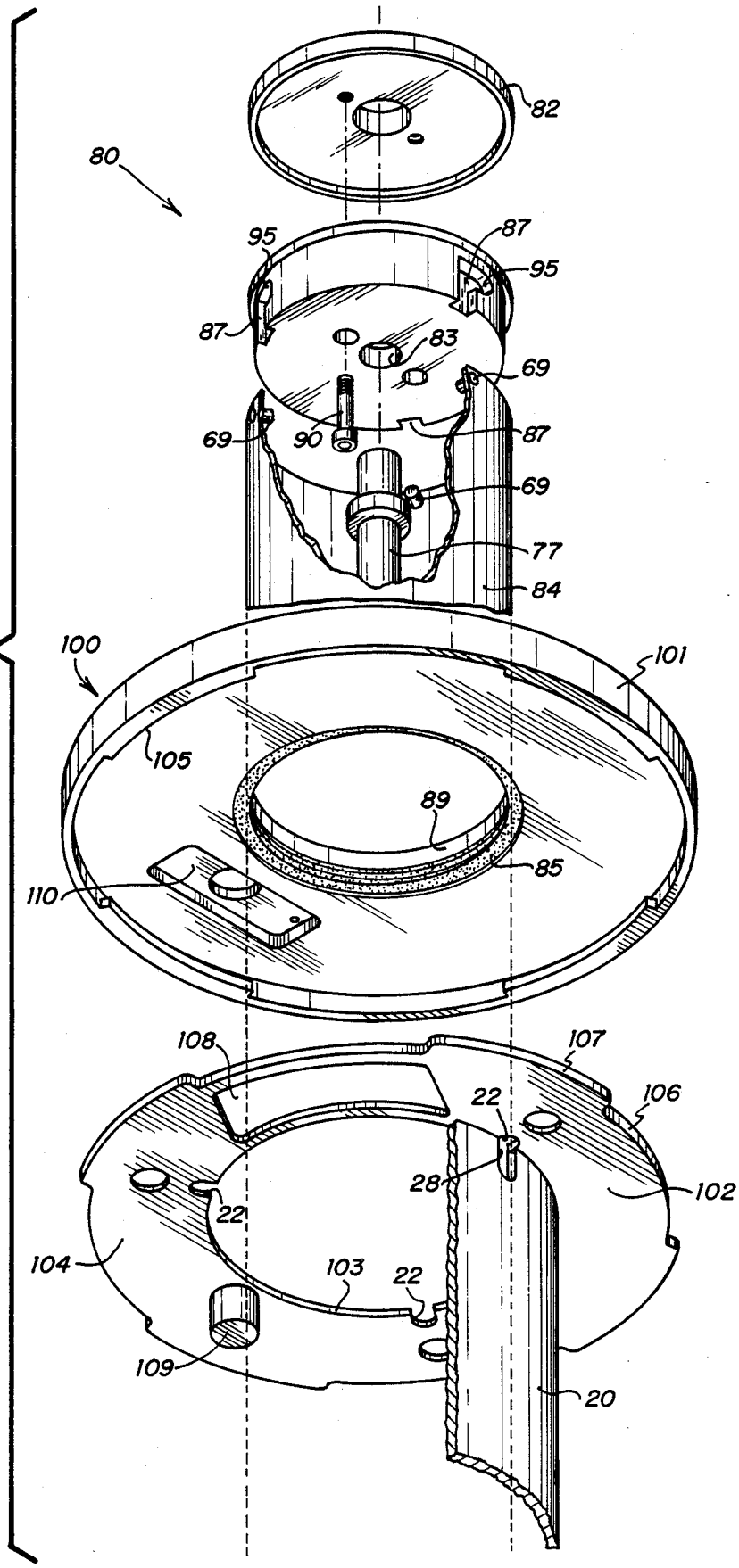
FIG. 5 is an exploded view of the scope tube lock plate and the bezel or security system assembly for retaining Scopelock in the permanent casing.

Referring now specifically to FIGS. 3, 6*a* and 6*b*, the scope tube assembly comprises lock plate 81, cap 82 and scope tube 84. The scope tube 84 is of sufficient diameter to maintain a close tolerance between the internal bore of the hanger top guide 27. An o-ring seal 85 provides a seal between scope tube 84 and cap plate or bezel 101 of anchor assembly 100. Scope tube 84 at its upper end, has three dowel pins 69 threaded into the internal wall of the scope tube 84. Lock plate 81 has three j-slots 87 as best shown in FIG. 5. A bore 88 connects one of the j-slots with the internal bore of lock plate 81. Cap 82 has a central bore 89 and is secured to lock plate 81 by two allen head bolts 90 which are counter-sunk. In addition, as best shown in FIGS. 6*a* and 6*b*, lock plate 81 has a tubular lock pin 91, with a reduced diameter segment 92 intermediate the ends of the lock pin 91. Lock plate 81 also has a slide cover 93 which moves in slide slot 94. Slide cover 93 also has a cover pin 97 that engages lock pin 91 for moving lock pin 91 intermittent with slide cover 93. The cap and lock plate are retained in the scope tube 84 by allen head bolts 86. To accomplish this, the cap and lock plate are fitted over j-slots 87 and rotated so that they are seated in toe 95 of the j-slots 87. Then, lock pin 91 slide cover 93 is slid back and cover pin 97 engages lock pin 91 moving into one of the j-slots 87 blocking rotation of the lock plate and cap to align the dowel pins 69 with the open end of j-slots 87. The lock pin 91 is blocked from movement into the bore of top plate 79 by a removable key lock 96. Such locks are quite common and are used in vending machines such as Coca Cola machines and so forth where the lock is completely removed from the bore. When the key lock 96 is removed from the bore of lock plate 81, the outer lock plate 81 may be rotated and removed permitting access to the limit switch adjusting assembly 120 to be later described as well as the internal bore of riser tube 77 exposing the top of drive shaft 60 which has a hexhead screw or allen head bolt 66 threaded therein which can be engaged by a suitable crank rod (not shown) and rotated only in a direction to lower the riser tube 77 and consequently the entire scope tube assembly 80.

Figure 8:
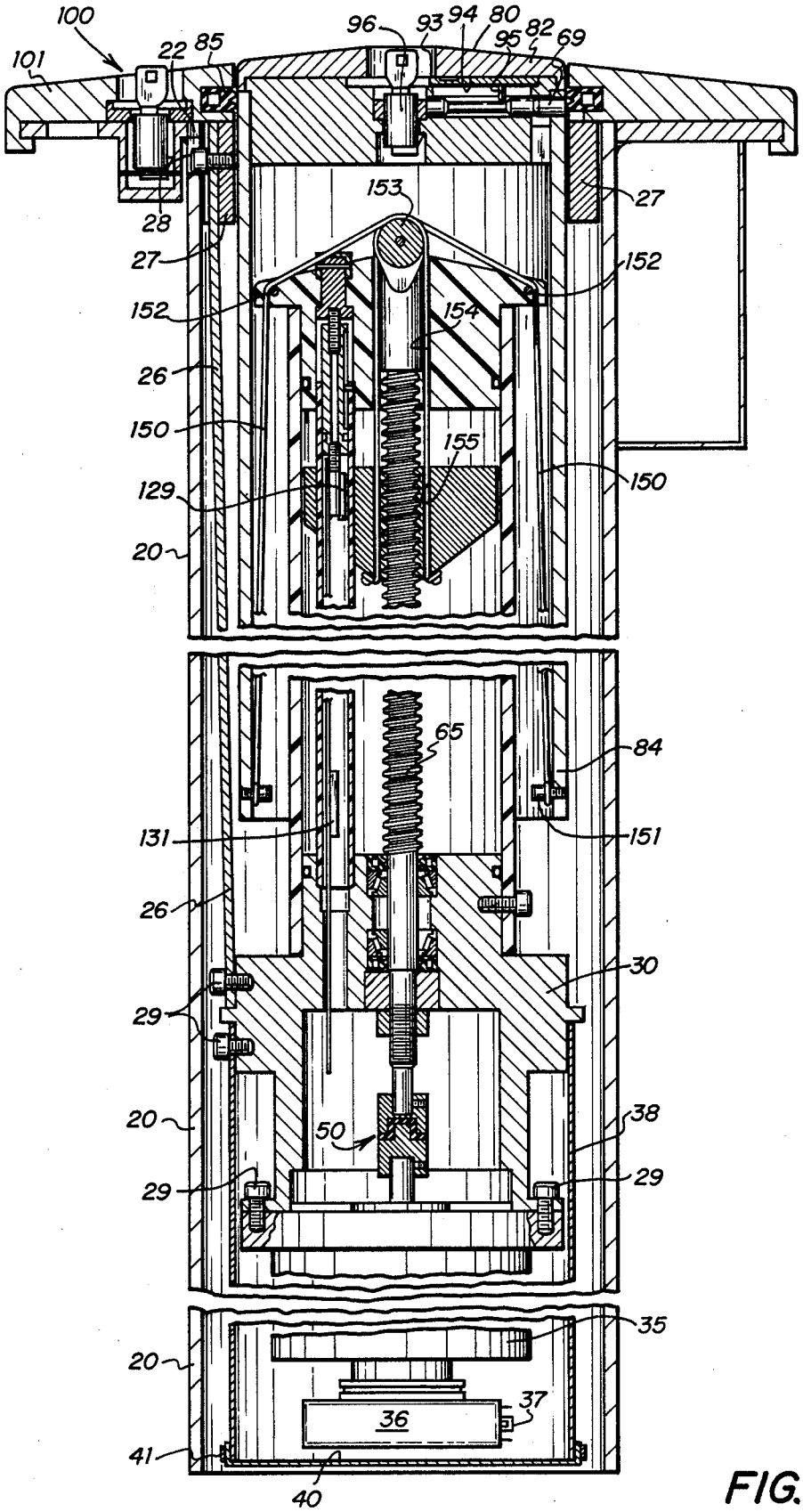
FIG. 8 is a sectional view taken along a segment of Scopelock to illustrate the screw drive assembly cable riser mechanism for the scope tube.

Referring now to FIGS. 3, 5 and 8, the anchor assembly 100 can be best understood. The uppermost butt end of cylindrical casing 20 is welded to the retainer flange 102 on the underside 104 around the internal periphery 103 of the retainer flange 102. Thus, the upper rim of cylindrical casing 20 abuts supports slots 22, forming a seat for allen screws 29. Scope tube assembly 80 is sealed to a bezel or cap plate 101 at the internal bore thereof by seal 85. The retainer flange 102 has an erose perimeter with three protrusions 107. Cap plate 101 has an erose flange with three inward projections 105. The erose flange of cap plate 101 and the erose perimeter of retainer flange 102 complement each other such that when cap plate 101 is positioned over retainer flange 102 and rotated, the cap plate 101 and its flange projections 105 interlock with the perimeter protrusions 107 of retainer flange 102 which prevents lifting of the cap plate or bezel 101. Retainer flange 102 has a cut out 108 which is aligned over the top of electronic box 21 permitting access thereto when cap plate 101 is removed. Retainer flange 102 also has a lock well 109 which is aligned with locking port and slot 110 when cap plate 101 is interlocked with retainer flange 102. In this position a key lock may be inserted within locking port and slot 110 and extends into lock well 109. When locked, the lock wings extend in the slot portion of locking port and slot 110 thus preventing removal of the lock. Since the lock cannot be removed, the cap plate or bezel 101 cannot be rotated from its interlocked position for removal. Scope tube assembly 80 is sealed to cap plate 101 at the internal bore thereof by seal 85.

Figure 4B:
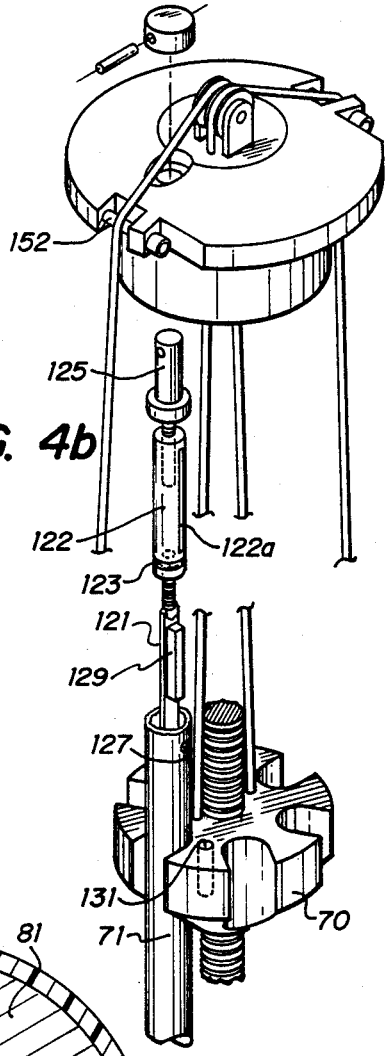

Referring now to FIGS. 3, 4*b* and 8, limit switch adjusting assembly 120 can be best understood. A rigid magnetic carrier strip 121 carries upper magnet 129 and lower magnet 130 which are spaced apart a preset distance. Upper magnet 129 and lower magnet 130 in conjunction with traveler magnet 131, affixed to nonmagnetic traveler nut 70, provide the upper and lower proximity signal for shutting off the motor 35 and stopping the operation of Scopelock in either the raised or lowered position. The top of magnetic carrier strip 121 is threadably connected into the lower end of connector tube 122 which has an O-ring seal 123. The upper end of connector tube 122 is threadably engaged with adjusting screw 125 which is seated in and sealed to plastic cover 67. The adjusting screw 125 has an adjusting screw cap 126 which permits the adjusting screw 125 to be positions within or removed from plastic top cover 67. The connector tube 122 has a guide slot 122*a*. A pin 127 in the plastic tube 22 extends into slot 122*a* to prevent connector tube 122 form rotating. In order to adjust the height at which traveler nut 70 stops when motor 35 is shut off the adjusting screw is rotated clockwise to raise the connector tube 122 and hence magnet carrier strip 121 to reposition upper magnet 129 and lower magnet 130 in tandem. It will be noted that the travel of the traveler nut 70 is fixed by the distance between upper magnet 129 and lower magnet 130.

Referring now specifically to FIGS. 3 and 8, the flexible coupling can best be understood. A Love Joy coupling 50 attaches motor shaft 51 to drive shaft 60 through the Love Joy coupling which is a well known flexible coupling for connecting motor drive shafts to and driven shafts. The Love Joy coupling 50 is secured to the motor shaft 51 by set screw 52 and to the drive shaft by set screw 53.

Referring now specifically to FIG. 8, the cable riser system can best be understood. Considering the previously described tube riser system, it will be understood except as specifically modified hereby the operation of the cable riser and the tube riser are substantially the same. Instead of a riser tube, a cable is attached on the opposite diameters of scope tube 84 at the lower ends thereof by allen head bolts 151. Each cable passes over a roller guide 152 through a pulley 153, affixed in the top plastic cover 67 and the cables 150 are received through ports 154 in the top plastic cap 67 and ports 155 in the traveler nut 70 and the cable ends 156 are secured to the bottom side of traveler nut 70 by allen head bolts 157. In operation, as the traveler nut 70 traverses down the multiple lead thread 65 of the drive shaft 60, scope tube 84 rises or is erected as a result of the cable action. Although not shown, pulleys 153 and cable 150 can be arranged to provide access through the top plastic cover 67 to the top of drive shaft 60 which contains a hexhead bolt which can be used to raise the traveler nut 70 and thus lower the scope tube 84.

It will be observed in the cable riser system that the bollard is the only object extended above the surface of the vehicle way. Consequently, only the bollard is susceptible to being damaged by being struck by a vehicle. When used in controlling traffic in traffic ways such as lane markers for reversing traffic flow, the bollards can be made of a plastic material which if struck by a car would not damage the vehicle or restrict the movement of the vehicle, possibly causing a hazard. Thus, the cable riser system can be used to control traffic flow with limited risk of damage to either the control system or vehicles in the traffic way.

The Scopelock invention is not limited to the embodiments described above, and all changes and modifications thereof not constituting departures from the spirit and scope of the invention are intended to be covered by the following claims:

What is claimed is:

1. A vehicular barrier system for restricting movement in a vehicle way, placed below the surface of such vehicle way including a bollard selectively protuberant above the surface of such vehicle way comprising:

a casing implanted below such vehicle way, said casing having a flange with an erose perimeter;

an electromechanical drive mechanism including a reversible motor retained within said casing and coupled to the bollard for erecting or retracting the bollard to or from a protuberant position obstructing movement in such vehicle way;

a bezel surrounding the bollard and having a rim with an inwardly directed erose flange rotatably interlockable with said erose perimeter for restricting access to the electromechanical drive mechanism;

a locking assembly means for preventing removal of the bezel when engaged and allowing removal of the bezel when disengaged thereby permitting access to the electromechanical drive mechanism for replacement or repair;

an electronic control means associated with the motor of the electromechanical drive mechanism for activating the motor to operate the electromechanical drive mechanism for erecting or retracting the bollard.

2. A vehicular barrier system for restricting ingress to or egress from vehicle way, placed below the surface of such vehicle way including a bollard selectively protuberant above the surface of such vehicle way comprising:

a casing implanted below such vehicle way, said casing having a flange with an erose perimeter, a lock well and an access port;

an electromechanical drive mechanism retained within said casing and coupled to the bollard for erecting or retracting the bollard to or from a protuberant position obstructing ingress to or egress from such vehicle way;

a bezel surrounding the bollard including a lock port and having a rim with an inwardly directed erose flange rotatably interlockable with said erose perimeter for restricting access to the electromechanical drive mechanism;

a locking assembly means for preventing relative rotation between said erose flange and said erose perimeter when installed and interlocked through the lock port into the lock well and allowing relative rotation between said erose flange and said erose perimeter when removed, thereby permitting removal of the bezel and access to the electromechanical drive mechanism for replacement or repair;

an electronic control means associated with the electromechanical drive mechanism for operating electromechanical drive mechanism to erect or retract the bollard;

a remote control means for activating said electronic control means.

3. A vehicular barrier system for restricting movement in a vehicle way, placed below the surface of such vehicle way including a bollard selectively protuberant above the surface of such vehicle way comprising:

a casing implanted below such vehicle way;

an electromechanical drive mechanism including a reversible motor retained as a unit within said casing and coupled to the bollard for erecting or retracting the bollard to or from a protuberant position obstructing movement in such vehicle way;

a bezel surrounding the bollard and releasably secured to said casing for restricting access to the electromechanical drive mechanism;

a locking assembly means integral with the bollard permitting limited rotation for access to the bollard for replacement, adjustment or repair;

an electronic control means associated with the motor of the electromechanical drive mechanism for activating the motor to operate the electromechanical drive mechanism for erecting or retracting the bollard.

4. The vehicular barrier system of claim 3 wherein the electromechanical drive mechanism further includes:

a drive shaft having a threaded region, a traveler nut threaded upon the threaded region of the drive shaft, said drive shaft coupled to said motor;

a main bearing housing for the drive shaft;

a tubular plastic housing seated over the main bearing housing;

a plastic cover for said tubular plastic housing;

a roller guide means within said plastic cover;

a cable means secured to the traveler nut extending through the plastic cover over the roller guide means and secured to the lower end of the bollard; and a stabilizer means to prevent rotation of the traveler nut with the drive shaft, thereby causing the traveler nut to move up or down the threaded region of the drive shaft carrying the cable means and bollard therewith when the drive shaft rotates.

5. The vehicular barrier system of claim 4 wherein the traveler nut is fluted and of non-magnetic material and the stabilizer means includes a tubular plastic guide extending from the main bearing housing to the plastic cover with the fluted area of the traveler nut engaging the plastic guide and includes;

a proximity switch mechanism including an adjustable magnetic carrier with a magnet at the upper end and at the lower end seated within the plastic guide;

said traveler nut of non-magnetic material having a magnet carried thereon; and said electronic control means including means for activating the motor and deactivating the motor responsive to the magnet carried by the traveler nut approaching the proximity of the upper magnet or the lower magnet.

6. The vehicular barrier system of claim 3 wherein the electromechanical drive mechanism further includes a drive shaft having a threaded region, a traveler nut threaded upon the threaded region of the drive shaft, said drive shaft coupled to said motor and includes:

a riser tube, surrounding the drive shaft, secured at the lower end to the traveler nut and at the upper end to the bollard, and a stabilizer means to prevent rotation of the traveler nut with the drive shaft, thereby causing the traveler nut to move up or down the threaded region of the drive shaft carrying the riser tube and bollard therewith when the drive shaft rotates.

7. The vehicular barrier of claim 6 which includes a main bearing housing for the drive shaft, a tubular plastic housing surrounding the traveler nut and seated over and sealed to the main bearing housing, and a plastic cover for said tubular plastic housing surrounding and sealed to the riser tube.

8. The vehicular barrier system of claim 7 wherein the traveler nut is fluted and the stabilizer means includes a tubular plastic guide extending from the main bearing housing to the plastic cover with the fluted area of the traveler nut engaging the plastic guide.

9. The vehicular barrier system of claim 8 which has a proximity switch mechanism including:

an adjustable magnetic carrier with a magnet at the upper end and at the lower end seated within the plastic guide;

a traveler nut of non-magnetic material with a magnet carried thereon; and an electronic control means for activating the motor and deactivating the motor when the magnet carried by the traveler nut approaches the proximity of the upper magnet or the lower magnet.

10. The vehicular barrier system of claim 9 in which the drive shaft has a top crank port for mechanically lowering the bollard.

11. The vehicular barrier system of claim 3 wherein the electronic box containing said electronic control means is concealed under the bezel and is accessible when the bezel is removed for repair or replacement of the electronic controls.

12. The vehicular barrier system of claim 4 wherein the bollard is made of a breakable plastic to prevent vehicular damage upon striking said bollard.

* * * * *